US008496550B2

(12) United States Patent
Zeren

(10) Patent No.: US 8,496,550 B2
(45) Date of Patent: Jul. 30, 2013

(54) HIGHLY EFFICIENT IMPACT OPERATIVE ARROWHEADS

(76) Inventor: Joseph D. Zeren, Boulder, CO (US)

( * ) Notice: Subject to any disclaimer, the term of this patent is extended or adjusted under 35 U.S.C. 154(b) by 0 days.

(21) Appl. No.: 13/374,342

(22) Filed: Dec. 23, 2011

(65) Prior Publication Data

US 2013/0165280 A1 Jun. 27, 2013

(51) Int. Cl.
*F42B 6/08* (2006.01)

(52) U.S. Cl.
USPC ..... 473/583

(58) Field of Classification Search
USPC ..... 473/583, 584
See application file for complete search history.

(56) References Cited

U.S. PATENT DOCUMENTS

| | | | | |
|---|---|---|---|---|
| 4,099,720 | A | 7/1978 | Zeren | |
| 5,066,021 | A | 11/1991 | DeLucia | |
| 5,082,292 | A * | 1/1992 | Puckett et al. | 473/583 |
| 5,083,798 | A | 1/1992 | Massey | |
| 5,100,143 | A | 3/1992 | Puckett | |
| 5,102,147 | A | 4/1992 | Szeluga | |
| 5,803,844 | A | 9/1998 | Anderson | |
| 5,879,252 | A | 3/1999 | Johnson | |
| 6,015,357 | A | 1/2000 | Rizza | |
| 6,270,435 | B1 | 8/2001 | Sodaro | |
| 6,669,586 | B2 * | 12/2003 | Barrie et al. | 473/583 |
| 6,830,523 | B1 | 12/2004 | Kuhn | |
| 6,910,979 | B2 | 6/2005 | Barrie et al. | |
| 7,677,995 | B1 | 3/2010 | Sanford | |
| 7,713,152 | B1 | 5/2010 | Tentler et al. | |
| 7,717,814 | B1 | 5/2010 | Sanford | |
| 7,780,554 | B1 | 8/2010 | Sanford | |
| 7,905,802 | B2 | 3/2011 | Erhard | |
| 7,951,024 | B2 | 5/2011 | Mizek | |
| 8,313,399 | B2 * | 11/2012 | Sanford | 473/583 |
| 2011/0165977 | A1 * | 7/2011 | Adams et al. | 473/583 |

* cited by examiner

*Primary Examiner* — John Ricci
(74) *Attorney, Agent, or Firm* — Harold A. Burdick

(57) ABSTRACT

A target impact operative arrowhead mountable at an end of an arrow shaft is disclosed that includes an arrowhead body and blade actuator axially and rotationally movable relative to one another. The arrowhead body has blades pivotably mounted thereon, each of the blades having an actuation contact surface along an edge thereof, and the actuator has a blade contacting end. A spring ring retains assembly of the body and actuator, one of the arrowhead body and the actuator having an annular retention seat for mounting of the spring ring and the other of the arrowhead body and the actuator having an annular guide groove for receipt of the spring ring therealong thus accommodating relative axial travel of the spring ring.

26 Claims, 13 Drawing Sheets

FIG. 1
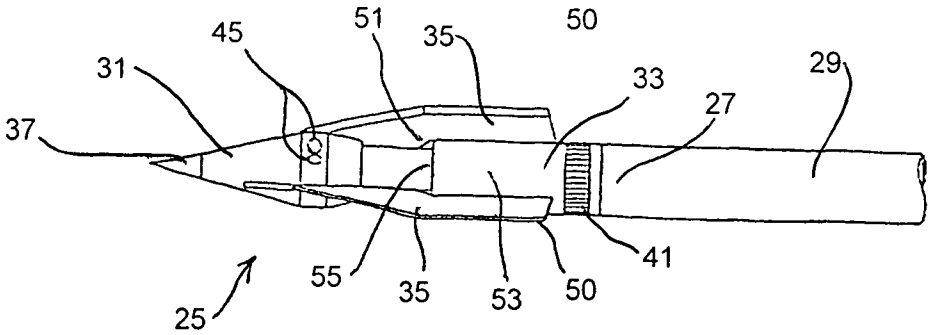
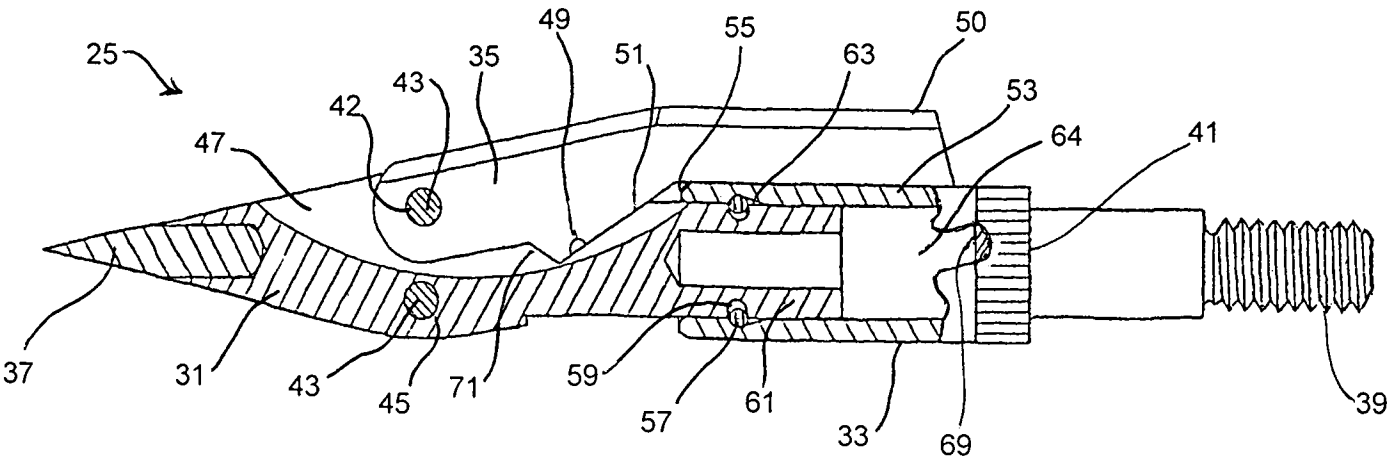
FIG. 3

HIGHLY EFFICIENT IMPACT OPERATIVE ARROWHEADS

FIELD OF THE INVENTION

This invention relates to archery arrows and, more particularly, relates to mechanically expanding arrowheads.

BACKGROUND OF THE INVENTION

Archery is practiced the world over. Fundamentally, archers use bows (or crossbows) to shoot arrows (or bolts) at targets. Archery is practiced both as a means for procuring game in the field and as sport (target shooting, archer's tournaments, demonstrations, or the like).

Presently there are generally four types of arrowheads (or points) used in the field of archery: arrowheads with fixed blades; arrowheads with removable blades (replaceable blade arrowheads); arrowheads with blades that open when the arrowhead strikes an object (expanding arrowheads of the broadhead and flip-blade variety); and arrowheads without blades (field tips, or target tips). All four of these arrowhead types are usually constructed from steel or lightweight metal (such as aluminum). In general, arrowheads can be described as having a tip end and a threaded (or other form) attachment end, whereby the arrowhead is attached to an arrow shaft. Manufacture of arrowheads having various weights is utilized to accommodate archers' preference for different trajectories and arrow speed (for example, 100 grain (GN) and 125 grain (GN) weight arrowheads are common).

A number of expanding arrowheads have heretofore been suggested and/or utilized (see, for example, U.S. Pat. Nos. 4,099,720, 7,713,152, 6,830,523, 6,270,435, 5,102,147, 5,100,143, 5,083,798, 5,066,021, 6,910,979, 7,951,024, 7,905,802, 7,677,995, 6,015,357, 5,879,252, and 5,803,844). Mechanical activation has been achieved using both internal actuators (U.S. Pat. No. 7,713,152, for example) and external actuators (U.S. Pat. No. 7,677,995, for example). A typical (and early) example is shown in U.S. Pat. No. 4,099,720 wherein a cam sleeve actuator is operative to deploy plural blades upon impact with a target. This design, like others, includes non-reusable blade retainers and arrow shaft adapters which, though effective, increase the total arrowhead weight and effect flight stability.

While these heretofore known arrowheads have met with some success in use, many are unduly complex, include non-reusable features requiring replacement with every arrow shot, can be susceptible to premature blade opening, have varying and unpredictable blade activation impact force requirements, are heavy and are not susceptible to lighter weight designs, and/or have an unduly large diameter effecting flight stability. Further improvement could thus still be utilized.

SUMMARY OF THE INVENTION

This invention provides several highly efficient impact operative arrowheads employing spring ring and groove blade activation control in both forward and rearward and internal and external blade activation implementations. The arrowheads of this invention are simple designs that are thus easy to maintain and less expensive to manufacture. They do not include non-reusable features such as blade retainers requiring replacement with every arrow shot, are resistant to premature blade opening, have consistent and repeatable blade opening impact force requirements, and are susceptible to light weight and small diameter design.

The target impact operative arrowhead is mountable at an end of a shaft of an arrow and includes an arrowhead body having blades pivotable thereon and an actuator axially slidably received at the body. At least a portion of each of the blades is movable into and out of slots in the body. The slots, the blades or both are configured for frictionally resisting movement of the blades thereby to hold the blades in the slots when the arrowhead is armed for firing while yet releasing the blades from the slots upon target impact. Each of the blades has an actuation contact surface along an edge thereof while the actuator has a blade contacting end which contacts the surface upon target impact to release and position the blades.

Depending upon specific configuration, either the arrowhead body or the actuator has an annular retention seat defined thereat for mounting and retention of a spring ring therein. The other of the arrowhead body and the actuator has an annular guide groove with an axial width for receipt of the spring ring therein and for axial sliding movement of the ring therealong upon target impact thus causing the blade contacting end of the actuator to contact the contact surfaces of the blades and releasing the blades from the slots in the body and pivoting the blades on the body into position for target penetration.

In one preferred embodiment, the arrowhead guide groove is tapered with a width extending between an armed end and a full ring compression end. In another embodiment the groove may be a constant depth. The actuator may be slidably receivable in the arrowhead body and have the annular retention seat thereat, or the body may be slidably receivable in the actuator and have the annular retention seat. The blade contacting end of the actuator can be configured as a striker pin or as a cam sleeve depending on other variables. The actuator can be located either forward or rearward of the pivoting mounting of the blades and may include the arrowhead penetrating tip when positioned forward.

Depending upon specific configuration, the arrowhead body may have either a cylinder portion having an internal annular surface or a piston portion having an external annular surface, the actuator configured structurally opposite with either a piston portion having an external annular surface where the arrowhead body is characterized by having the cylinder portion or a cylinder portion having an internal annular surface where the arrowhead body is characterized by having the piston portion. The piston portion is slidably receivable in the cylinder portion, the annular retention seat defined at the external surface of the piston portion and the annular guide groove axially spaced along the internal surface of the cylinder portion. Preferably, the cylinder portion, including a tapered guide groove, and the spring ring have relative size and material specifications selected for overcoming frictional resistance therebetween only upon application of between about 4 and 6 lbs. of force axially to the arrowhead (i.e., upon target contact).

Using these structures, the piston portion and the cylinder portion are movable to a relative armed position ready for arrow firing with the spring ring at the first end of the guide groove and the blade contacting end of the opposite structure spaced from the actuation contact surfaces of the blades. Frictional resistance is overcome upon target contact (either or both at the blades/body interface or, where a tapered guide groove is provided, of the spring ring along the guide groove width at least to a full ring compression end of the tapered guide groove) so that the contacting end of the opposite structure contacts the actuation contact surfaces of the blades to release the blades from the slots and position the blades for target penetration. As can be appreciated, either the actuator or the arrowhead body may include an attachment mechanism thereat for securing the arrowhead on the arrow shaft, and either the actuator or the arrowhead body may include a target penetrating tip thereat, depending upon the specific arrangement of parts.

It is therefore an object of this invention to provide highly efficient impact operative arrowheads.

It is another object of this invention to provide impact operative arrowheads that are simple in design and that require no non-reusable parts and field reuse assembly.

It is another object of this invention to provide impact operative arrowheads that are less susceptible to premature blade opening and that exhibit consistent and repeatable blade opening impact force.

It is still another object of this invention to provide impact operative arrowheads that are susceptible to lighter weight and smaller diameter designs.

It is yet another object of this invention to provide highly efficient impact operative arrowhead designs having spring ring and groove blade activation control.

It is still another object of this invention to provide a target impact operative arrowhead mountable at an end of a shaft of an arrow that includes an arrowhead body having blades pivotably mounted thereon with at least a portion of the blades movable into and out of slots in the body, at least one of the slots and the blades configured for frictionally resisting movement of the blades to hold the blades in the slots when the arrowhead is armed for firing and releasing the blades from the slots upon target impact, each of the blades having an actuation contact surface along an edge thereof, an actuator axially slidably receivable at the arrowhead body and having a blade contacting end, a spring ring, and one of the arrowhead body and the actuator having an annular retention seat defined thereat for mounting and retention of the spring ring therein and the other of the arrowhead body and the actuator having an annular guide groove with an axial width for receipt and slidable movement of the spring ring therealong while retaining the arrowhead body and the actuator assembly, the guide groove located so that, upon target impact, the blade contacting end of the actuator comes into contact with the actuation contact surfaces of the blades due to relative sliding movement of the arrowhead body and the actuator thereby releasing the blades from the slots in the body and pivoting the blades on the body into position for target penetration.

It is yet another object of this invention to provide a target impact operative arrowhead mountable at an end of a shaft of an arrow that has flexible design characteristics to accommodate different arrow structures all based on spring ring and groove blade activation control, and specifically constant or tapered guide groove depth, oppositely configurable slidable actuator and arrowhead body relationship, different actuator blade contacting end configurations, and actuator location either forward or rearward of the pivotable arrowhead blades.

It is another object of this invention to provide a target impact operative arrowhead mountable at an end of a shaft of an arrow including an arrowhead body having pivotable blades mounted thereon with at least a portion of the blades movable into and out of slots in the body, at least one of the slots and the blades configured for frictionally resisting movement of the blades to hold the blades in the slots when the arrowhead is armed for firing and releasing the blades from the slots only upon target impact, each of the blades having an actuation contact surface along an edge thereof, the arrowhead body having one of a cylinder portion with an internal surface or a piston portion with an external surface, an actuator configured with an opposite structure, the opposite structure one of a piston portion having an external surface where the arrowhead body is characterized by having the cylinder portion or a cylinder portion having an internal surface where the arrowhead body is characterized by having the piston portion, the opposite structure having a blade contacting end, a spring ring, the piston portion slidably receivable in the cylinder portion and having an annular retention seat defined at the external surface thereof for mounting and retention of the spring ring therein, the cylinder portion having an annular guide groove with a width between first and second groove ends axially spaced along the internal surface thereof for receipt of the spring ring therein and for frictional axial sliding contact of the ring therewith along the width upon target impact, the cylinder portion including the guide groove and the spring ring having relative size and material specifications selected for overcoming frictional resistance therebetween only upon axial application of between about 4 and 6 lbs. of force to the arrowhead, and the piston portion and the cylinder portion movable to a relative armed position ready for arrow firing with the spring ring at the first end of the guide groove and the blade contacting end of the opposite structure spaced from the actuation contact surfaces of the blades, and upon target contact overcoming the frictional resistance allowing relative axial movement of the spring ring along the guide groove width at least to the second end of the guide groove so that the contacting end of the opposite structure contacts the actuation contact surfaces of the blades to release the blades from the slots and position the blades for target penetration.

It is still another object of this invention to provide a target impact operative arrowhead mountable at an end of a shaft of an arrow including an arrowhead body having blades mounted thereon for pivoting movement between an armed position and a target penetration position, each of the blades having an actuation contact surface along an edge thereof, an actuator axially slidably receivable at the arrowhead body and having a blade contacting end, a spring ring, one of the arrowhead body and the actuator having an annular retention seat defined thereat for mounting and retention of the spring ring therein and the other of the arrowhead body and the actuator having an annular guide groove with an axial width extending from a first groove end for receipt of the spring ring therein to provide assembly retention of the arrowhead body and the actuator while allowing relative axial travel of the arrowhead body and the actuator upon target impact to bring the blade contacting end of the actuator into contact with the actuation contact surfaces of the blades to pivot the blades on the body into the target penetration position, one of the actuator and the arrowhead body having attachment means thereat for securing the arrowhead on the arrow shaft, and one of the actuator and the arrowhead body having a target penetrating tip thereat.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which:

FIG. 1 is a side view of a first preferred embodiment of the arrowhead of this invention wherein rearward external blade activation is utilized;

FIG. 3 is a first sectional view of an arrowhead of the type shown in FIGS. 1 and 2 showing the arrowhead in the armed position;

DESCRIPTION OF THE INVENTION

Figure 2:
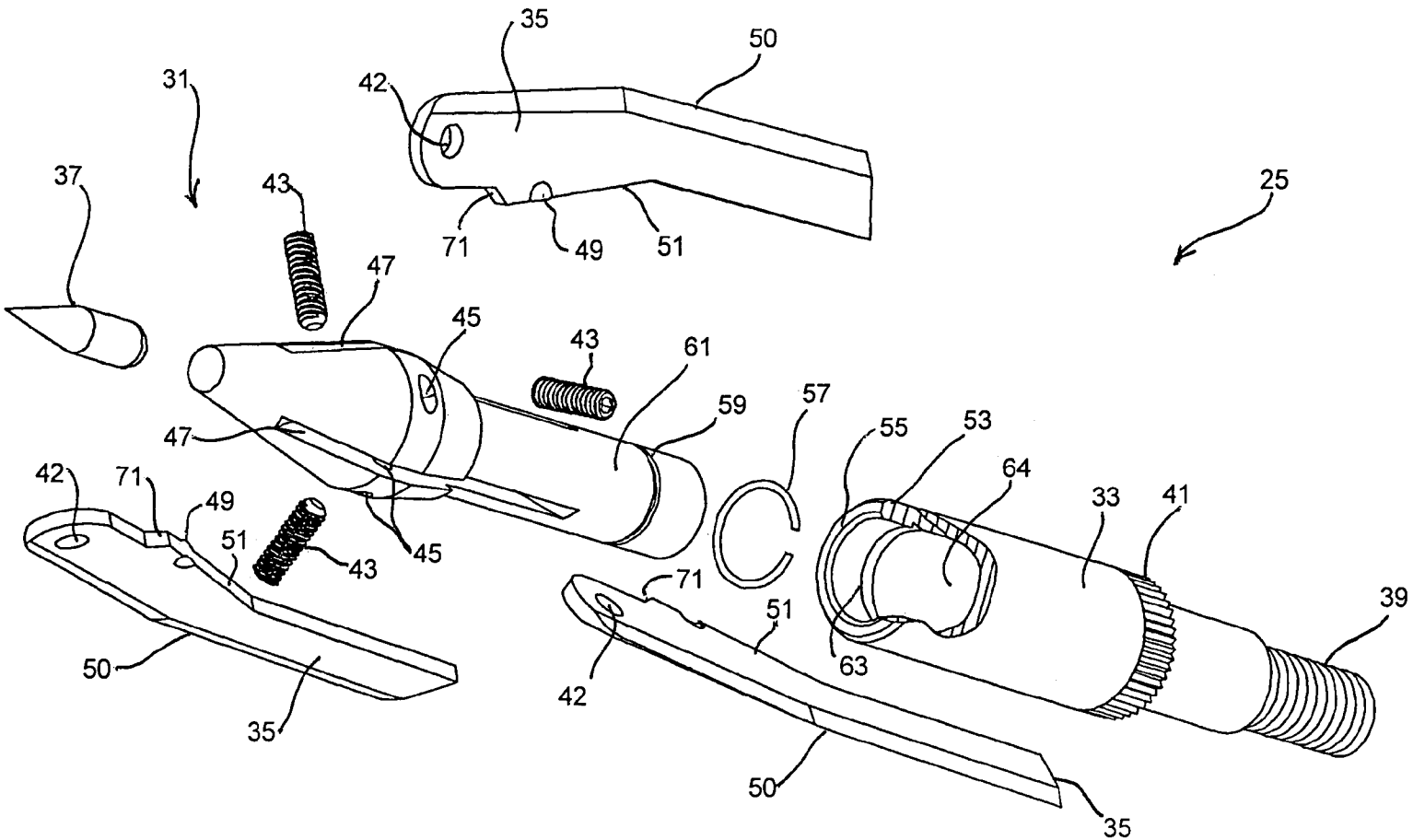
FIG. 2 is an exploded view of the arrowhead shown in FIG. 1 (three blade implementation shown)

As the description of this invention proceeds, it will become apparent that the spring ring and guide groove design for slidable arrowhead component attachment, retention and blade actuation as utilized in this invention is quite flexible and is adaptable to various target operative arrowhead types and implementations. As shown herein, the basic design characteristics are adaptable to both forward pivoting (upon actuation at target impact) blades of the traditional broadhead configuration and rearward pivoting, or flip, blades, utilization of blade actuation mechanism either forward or rearward of the blades, either interior or exterior blade actuation utilizing either cam sleeve or striker pin type actuators, various guide groove configurations, and variously configured slidable actuator and arrowhead body relationships. Thus, where design elements are common to all embodiments illustrated herein, the numbering of such elements will be retained throughout the drawings of the various embodiments as this description proceeds.

Turning now to FIGS. 1 through 4, a first preferred embodiment 25 of the target impact operative arrowhead of this invention is illustrated, a broadhead design. Arrowhead embodiment 25 is mountable at end 27 of shaft 29 of an arrow, and includes arrowhead body 31 and actuator 33 relatively axially slidably and (preferably) rotationally retained with each other in an assembly. Blades 35 are pivotably mounted at body 31 (three shown in the drawing herein, though two opposed blades can be utilizable in this invention, as can configurations using more than three blades) and target penetrating tip 37 is secured (press fit for example) at the leading end of the arrowhead. Arrow shaft mounting structure includes threaded shaft engagement post 39 (receivable in a threaded arrow shaft end opening) and mount facilitating annular knurl 41.

Figure 11:
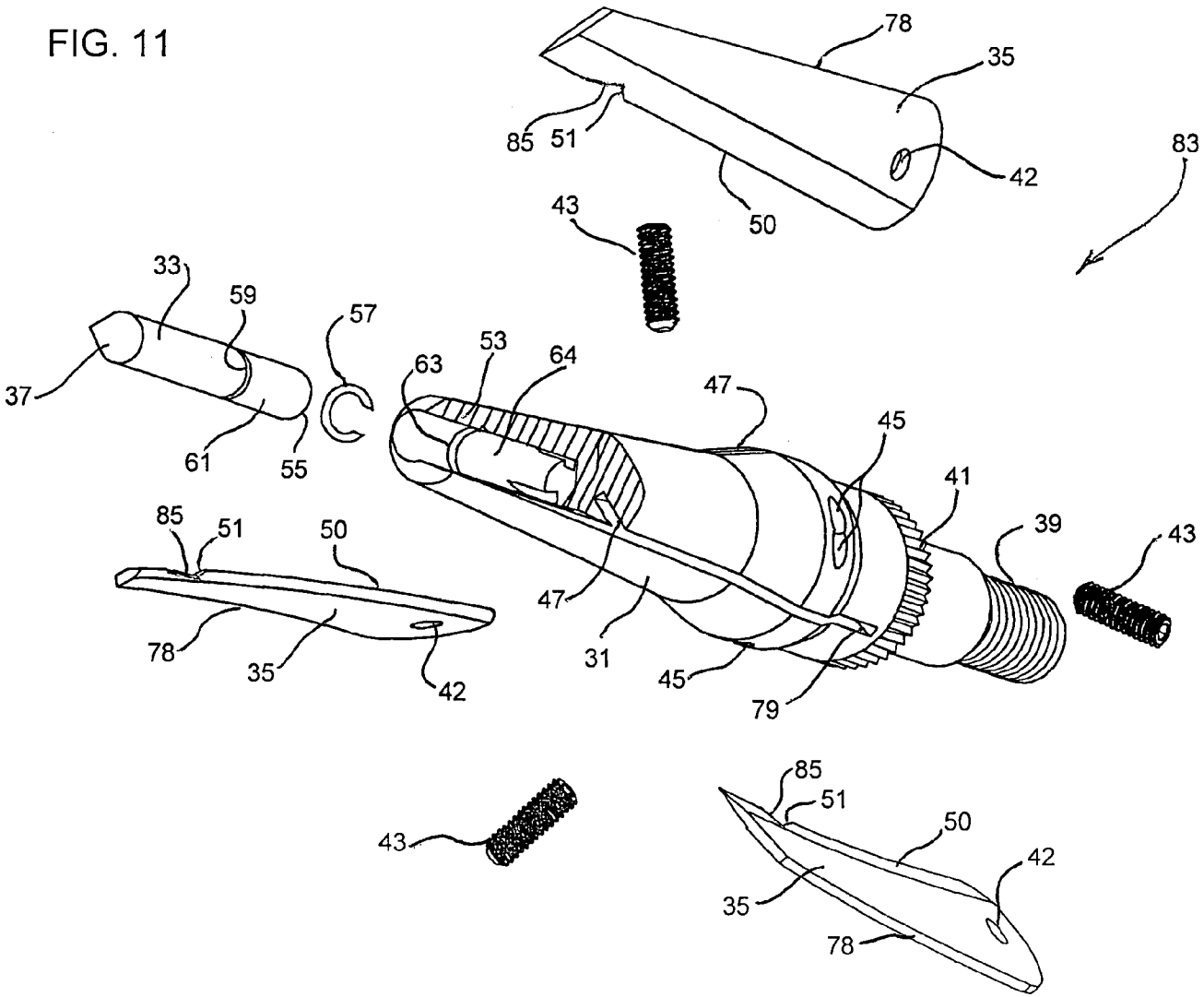
FIG. 11 is an exploded view of an arrowhead in accord with FIG. 10 showing a blade curvature feature utilized in providing frictional resistance to blade opening in various embodiments of this invention (blade curvature exaggerated for purposes of illustration)
Figure 15:
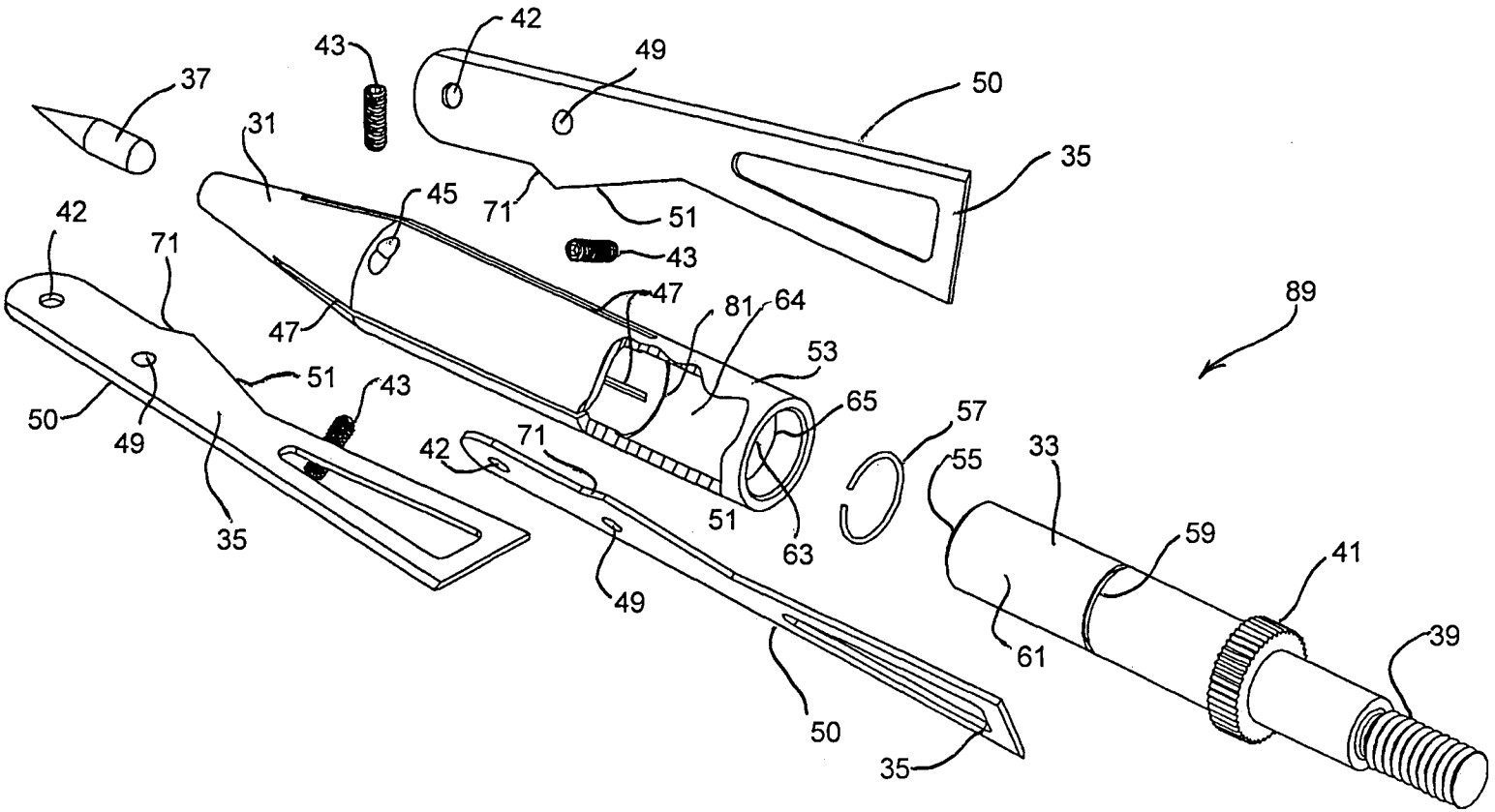
FIG. 15 is an exploded view of the arrowhead shown in FIG. 14.

Blades 35 are pivotably mounted on bores 42 at body 31 on set screws 43 (preferably Allen type) held at threaded openings 45 in body 31. Bores 42 are sized to allow free rotation of blades 35 on set screws 43. Linear slots 47 extend onto body 31 to receive at least a portion of blades 35 therein when the arrowhead is in the armed position ready for firing. Different blade features, such as dimples 49 in FIGS. 2 and 15 or blade curvature as shown in FIG. 11, cause blade contact with arrowhead body 31 in slots 47 when in the armed position to provide frictional resistance to blade opening from the armed position ready for firing and prior to target impact while yet allowing release of the blades from the slots upon target impact. While blade features for this purpose are illustrated, it should be realized the features could be implemented in body slots 47 to achieve the desired frictional resistance to premature opening. Blades 35 have honed (cutting) edges 50 and actuation contact surfaces 51 along an edge thereof.

Embodiment 25 specifically shows rearward external blade actuation of a broadhead type blade configuration (pivoting towards the forward section of the arrowhead body relative to the direction of arrow travel with cutting edges 50 of blades 35 exposed outside of slots 47 in the armed position) and having tip 37 mounted in the leading end of the forward section of body 31. Actuator 33 includes cylinder portion 53 having a blade contacting end 55 in the nature of a cam sleeve, actuation contact surfaces 51 of blades 35 in the nature of cam followers and extending to a position outside of slots 47 when the blades are in the armed position. Spring ring 57 (preferably stainless steel) is mounted in retention seat 59 at an external surface of piston portion 61 of body 31 and is received in annular guide groove 63 defined at an axial internal surface of axial bore 64 of cylinder portion 53. In all embodiments it is preferable that depth of annular guide groove 63, at least at first groove end 65, is sufficient to allow free relative rotation of arrowhead body 31 and actuator 33.

Figure 4:
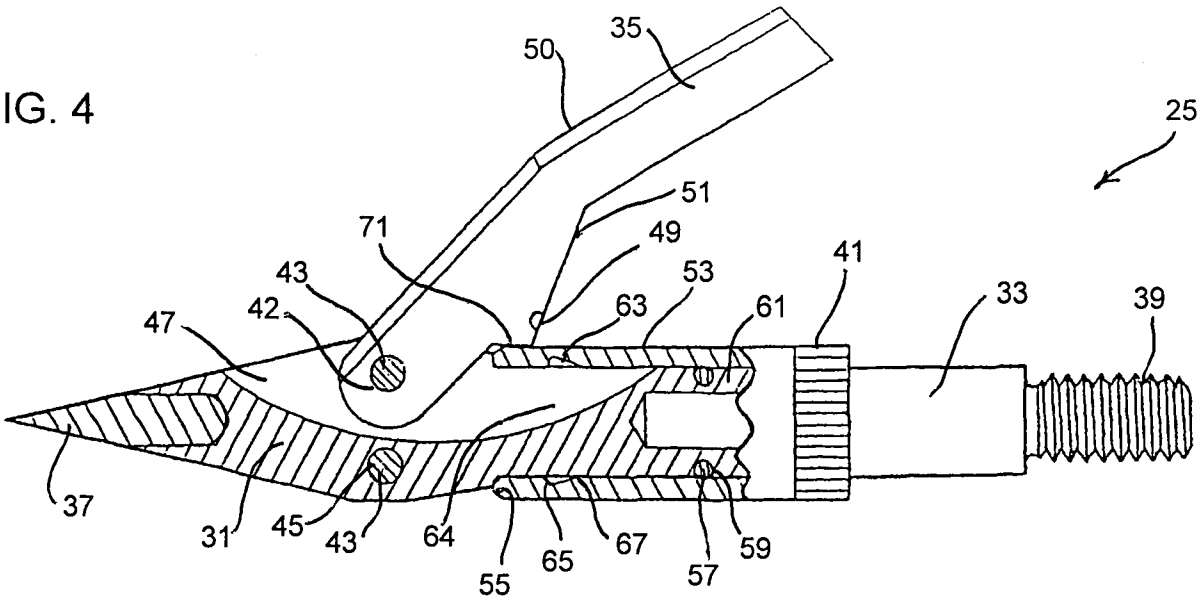
FIG. 4 is a second sectional view of the arrowhead of FIG. 3 showing the arrowhead in the activated position.

In embodiment 25 guide groove 63 is a tapered groove with an axial width extending from first end 65 (corresponding to ring location in the armed position) having a maximum groove depth to an axially spaced second end 67 (corresponding to a full ring compression achieved during ring travel in groove 63 after target impact and during blade activation) having zero groove depth (see FIG. 4). This arrangement provides for frictional axial sliding contact of ring 57 along the width of guide groove 63 upon target impact. Thus, arrowhead body 31 and actuator 33 assembly is retained by ring/groove 57/63 engagement and in this embodiment further by end wall 69 of cylinder portion 53 (FIG. 3), while accommodating relative axial sliding movement (or travel) of body 31 and actuator 33. As shown in FIGS. 3 and 4, guide groove 63 is located so that, upon target impact, blade contacting end 55 of actuator 33 comes into contact with actuation contact surfaces 51 of blades 35 due to forward inertia overcoming the frictional resistance at ring/groove 57/63 interface thus enabling the relative sliding movement of body 31 and actuator 33 to thereby release blades 35 from slots 47 in body 31 and pivot the blades on the body into position for target penetration (i.e., the target penetration position). Released blades are retained by continued engagement between blade contacting end 55 and released blade position retention surface 71 of blades 35.

The inception of frictional axial sliding contact at the ring/groove 57/63 interface upon target impact is configurable by selection of piston portion 61, cylinder portion 53 (including guide groove 63), and spring ring 57 relative sizes and material specifications to overcome frictional resistance therebetween only upon axial application of selected force at the arrowhead due to target contact (preferably between about 4 and 6 lbs.) The tapered guide groove is preferably tapered at an angle of between 10° to 20°, 15° of taper being preferred (resulting, given other constants, in about a 5 lbs. axial force application requirement to overcome the frictional resistance). In field operations, piston portion 61 and the cylinder portion 53 are moved to a relative armed position ready for arrow firing with spring ring 57 at first end 65 of guide groove 63 and blade contacting end 55 spaced from actuation contact surfaces 51 of blades 35. Upon target contact blades 35 are released from slots 47 and positioned for target penetration.

Turning to FIGS. 5 through 8, a second preferred embodiment 73 of the target impact operative arrowhead of this invention is illustrated, a flip-blade design. Embodiment 73 includes body 31, actuator 33 and blades 35 (differing in design but not overall function). Arrowhead body 31, as before, includes forward and rearward sections relative to intended direction of arrow travel, with tip 37 in the forward section, but with blades 35 mounted for pivoting movement from slots 47 toward the rearward section. Honed edges 50 of blades 35 are thus protected in slots 47 when in the armed position. Unlike embodiment 25, however, piston portion 61 is located at actuator 33 slidably receivable in cylinder portion 53 located at body 31 and includes arrow shaft engagement post 39 and knurl 41 at an end opposite blade contacting end 55. Blade contacting end 55 is located at one end of striker pin 75 mounted at its opposite end in bore 77 in piston portion 61 (press fit for example) and thus forms a part of piston portion 61.

Embodiment 73 specifically shows rearward internal blade activation of a flip-blade type blade configuration (pivoting towards the rearward section of the arrowhead body relative to the direction of arrow travel with cutting edges 50 of blades 35 located within slots 47 in the armed position). Actuation contact surfaces 51 of blades 35 in this embodiment are located entirely internal to body 31. Spring ring 57 is mounted in retention seat 59 at an external surface of piston portion 61 and is received in annular guide groove 63 defined at an axial internal surface of axial bore 64 of cylinder portion 53.

Figure 8:
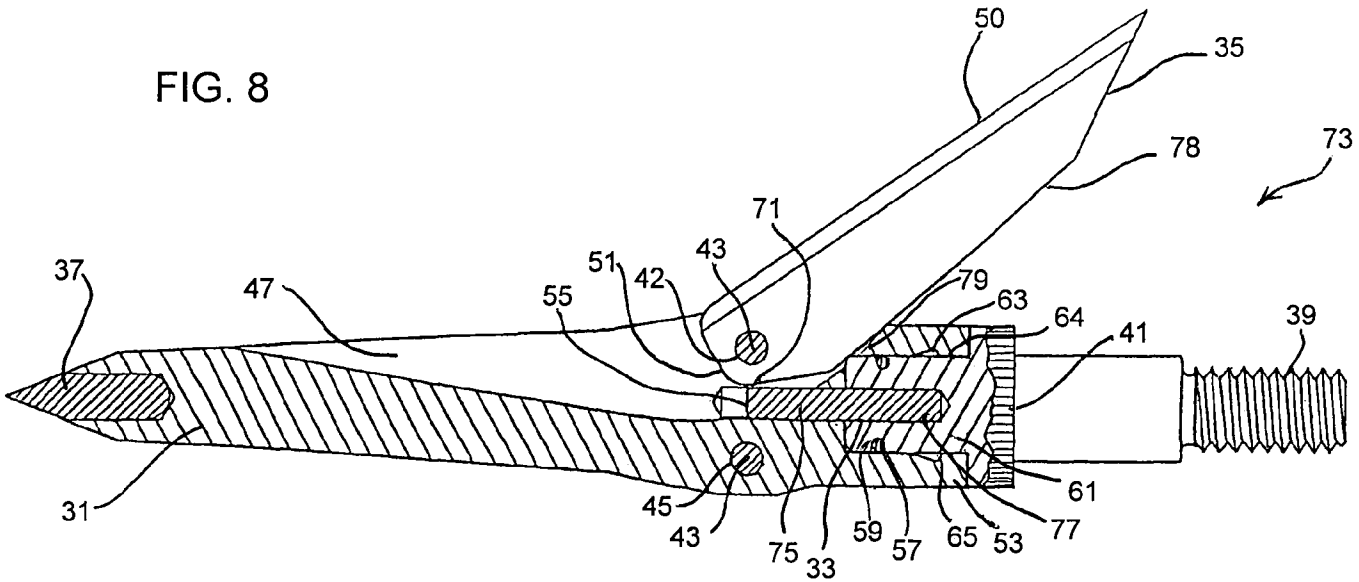
FIG. 8 is a second sectional view of the arrowhead of FIG. 5 showing the arrowhead in the activated position.
Figure 7:
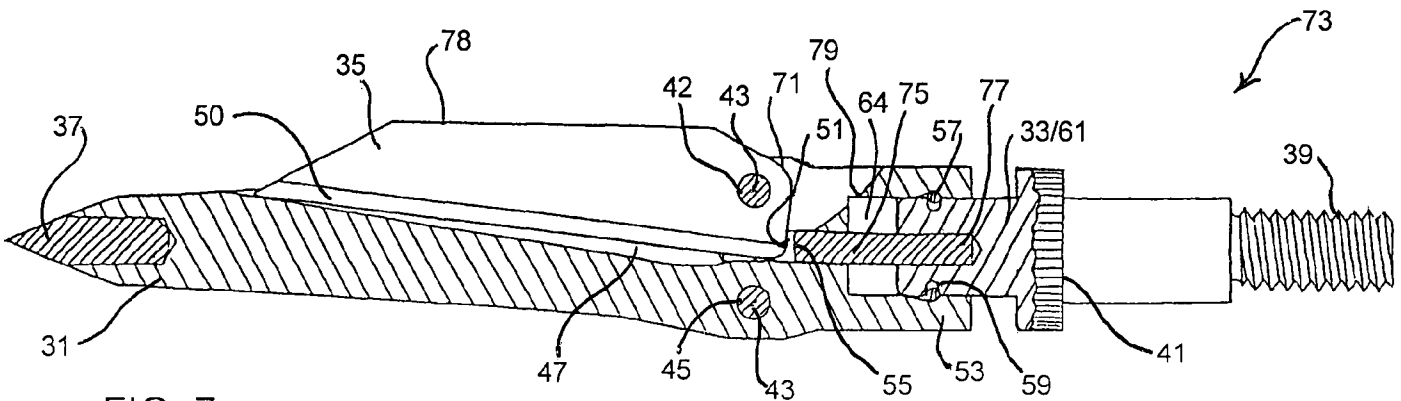
FIG. 7 is a first sectional view of an arrowhead of the type shown in FIG. 5 showing the arrowhead in the armed position.

In embodiment 73 guide groove 63 is a tapered groove much as previously described with regard to embodiment 25 except that assembly retention is maintained solely by guide groove end 65 (forming a positive stop to rearward ring travel thereat). As shown in FIGS. 7 and 8, guide groove 63 is located so that, upon target impact, blade contacting end 55 of striker pin 75 of actuator 33 comes into contact with actuation contact surfaces 51 of blades 35 due to forward inertia overcoming the frictional resistance at ring/groove 57/63 interface thus enabling the relative sliding movement of body 31 and actuator 33 to thereby release blades 35 from slots 47 in body 31 and pivot the blades on the body into position for target penetration. Released blades are retained by the rear edges 78 of blades 35 abutting back wall 79 of slots 47. The particular structures of this arrangement allow an arrow pulled from a target to return to its armed position by the very act of target disengagement.

As before, configuration of component sizes, guide groove taper and material specifications are selectable to overcome frictional resistance therebetween only upon axial application of selected force at the arrowhead due to target contact (preferably between about 4 and 6 lbs.). In field operations, piston portion 61 and cylinder portion 53 are moved to a relative armed position ready for arrow firing with spring ring 57 at first end 65 of guide groove 63 and blade contacting end 55 spaced from actuation contact surfaces 51 of blades 35. Upon target contact, blades 35 are released from slots 47 by striker pin 75 contact with blades 35 and thereby positioned for target penetration.

Figure 9:
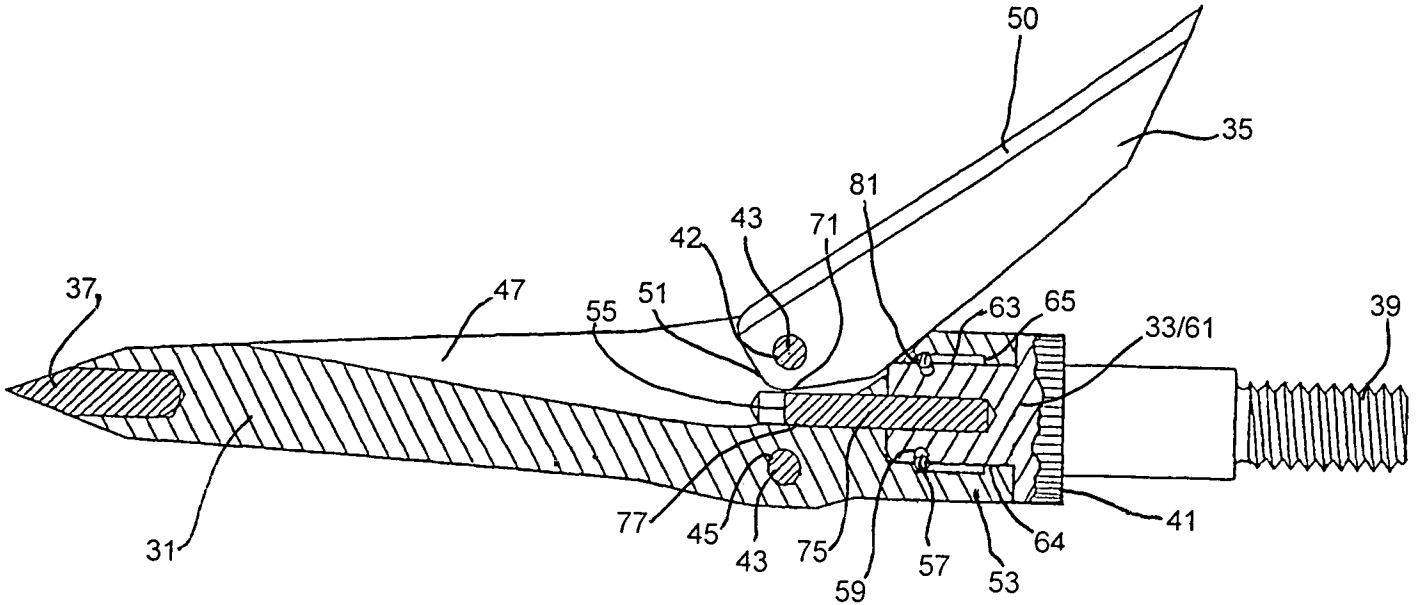
FIG. 9 is another sectional view of an arrowhead similar to that shown in FIG. 5 in most regards but using a different guide groove configuration.

FIG. 9 illustrates a variation applicable with embodiment 73 wherein annular guide groove 63 extends between first end 65 (corresponding to blade location in the armed position) and second end 81, guide groove 63 having a substantially constant depth along the width between ends 65 and 81. Positive stops are thus defined at or adjacent to the ends of the guide groove, spring ring 57 slidable between the positive stops (preferably short of end 81 to prevent ring damage). In this variation, guide groove depth is sufficient to accommodate free relative rotation of body 31 and actuator 33, features of blades 35 or slots 47 (blade curvature, dimples 49 or other features located at the blades or slots) providing the frictional resistance to premature blade opening from the armed position prior to target impact.

Figure 10:
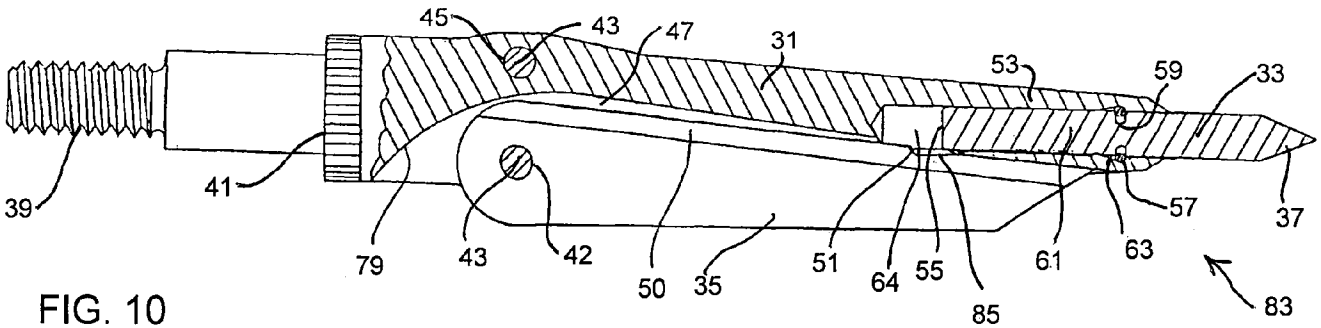
FIG. 10 is a sectional view of a third preferred embodiment of the arrowhead of this invention wherein forward internal blade activation is utilized with reverse blade orientation and activation direction and shown in the armed position (two blade implementation shown)
Figure 12:
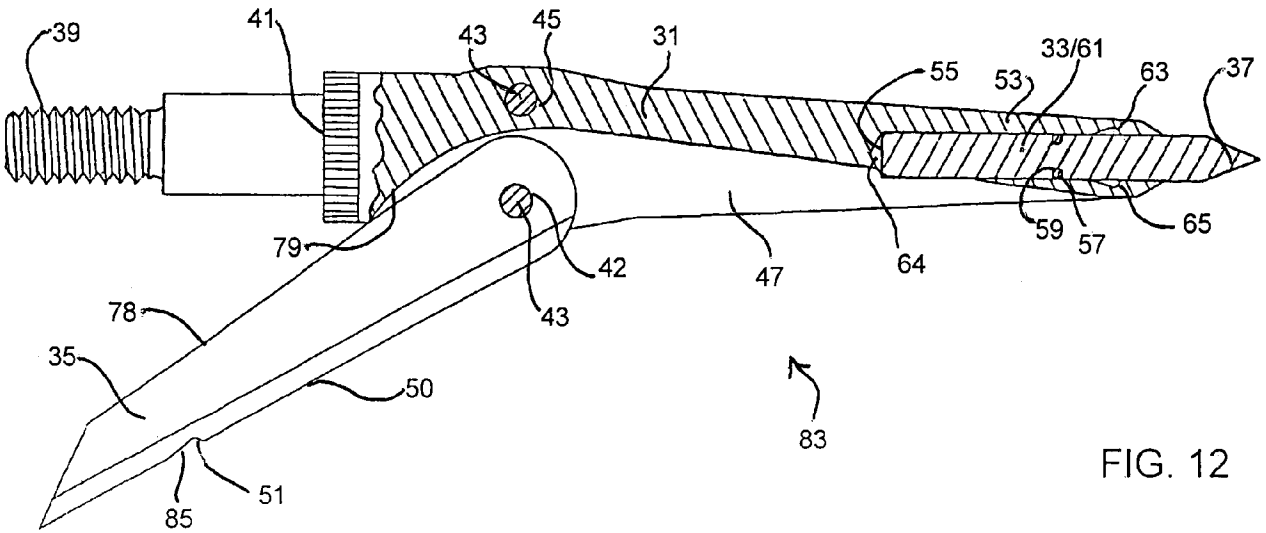
FIG. 12 is a second sectional view of the arrowhead of FIG. 10 showing the arrowhead in the activated position.

FIGS. 10 through 12 illustrate a third preferred embodiment 83 of the target impact operative arrowhead of this invention, yet another flip-blade design. Embodiment 83 includes body 31, actuator 33 and blades 35 (again differing in design but not overall function). As before, arrowhead body 31 includes forward and rearward sections relative to intended direction of arrow travel, with tip 37 incorporated into actuator 33 toward the forward section, and with blades 35 mounted for pivoting movement from slots 47 toward the rearward section. Honed edges 50 of blades 35 are protected in slots 47 in the armed position. Piston portion 61 is thus collocated with tip 37 at actuator 33 and slidably receivable in axial bore 64 of cylinder portion 53 located at body 31 with tip 37 protruding from axial bore 64. Body 31 includes arrow shaft engagement post 39 and knurl 41 at its rearward section. Blade contacting end 55 of actuator 33 is located at an end thereof opposite tip 37, actuator 33 thus configured as a forwardly disposed striker pin.

Embodiment 83 specifically shows forward internal blade activation of a flip-blade type blade configuration (pivoting towards the rearward section of the arrowhead body relative to the direction of arrow travel with cutting edges 50 of blades 35 located within slots 47 in the armed position). Actuation contact surfaces 51 at striker notches 85 in this embodiment are located at honed edge 50 of blades 35. Spring ring 57 is mounted in retention seat 59 at an external surface of piston portion 61 and is received in annular guide groove 63 defined at an axial internal surface of axial bore 64 of cylinder portion 53.

Guide groove 63 is a tapered groove much as previously described with regard to the prior embodiments, assembly retention maintained by the positive stop of guide groove end 65. As shown in FIGS. 10 and 12, guide groove 63 is located so that, upon target impact at tip 37, blade contacting end 55 of piston 61/actuator 33 comes into contact with actuation contact surfaces 51 of blades 35 due to forward inertia overcoming the frictional resistance at ring/groove 57/63 interface thus enabling the relative sliding movement of body 31 and actuator 33 to thereby release blades 35 from slots 47 in body 31 and pivot the blades on the body into position for target penetration. Positioning of the released blades is established by the rear edges 78 of blades 35 abutting back wall 79 of slots 47.

Again, configuration of component sizes, guide groove taper and material specifications are selectable to overcome frictional resistance therebetween only upon axial application of selected force at the arrowhead due to target contact (preferably between about 4 and 6 lbs.). In the field, piston portion 61 and cylinder portion 53 are moved to a relative armed position ready for arrow firing with spring ring 57 at first end 65 of guide groove 63 and blade contacting end 55 spaced from actuation contact surfaces 51 of blades 35. Upon target contact blades 35 are released from slots 47 by actuator 33 contacting contact surfaces 51 at notches 85.

Figure 13:
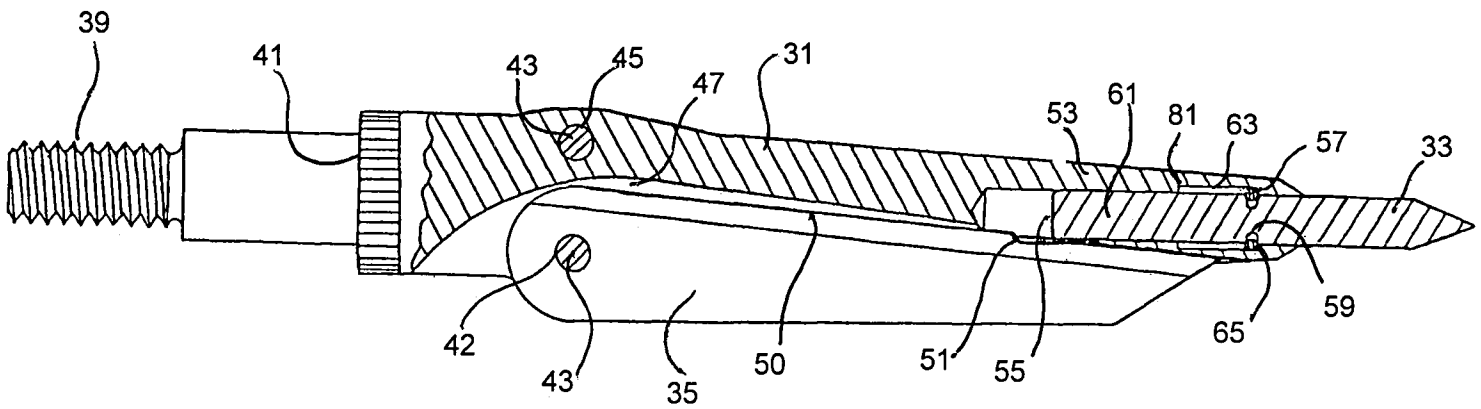
FIG. 13 is another sectional view of an arrowhead similar to that shown in FIG. 10 in most regards but using a different guide groove configuration.
Figure 14:
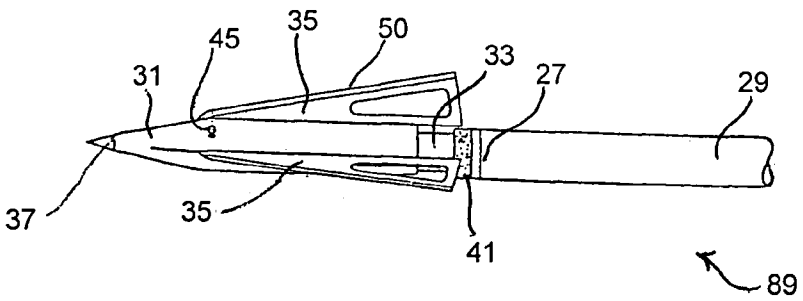
FIG. 14 is a side view of a fourth preferred embodiment of the arrowhead of this invention wherein a different rearward internal blade activation mechanism is utilized with blade orientation and activation direction similar to that shown in FIG. 1 (three blade implementation shown)

A variation applicable with embodiment 83 is shown in FIG. 13 wherein annular guide groove 63 extends between first end 65 and second end 81. Guide groove 63 has a substantially constant depth along the width between ends 65 and 81, positive stops thus defined at or adjacent to both ends of the guide groove. Spring ring 57 is slidable between the positive stops (but just short of end 81), with guide groove depth sufficient to accommodate free relative rotation of body 31 and actuator 33. As was true for the variation to embodiment 73 shown in FIG. 9, features of blades 35 or slots 47 (blade curvature as shown in FIG. 11, dimples 49 or other features located at the blades or slots) provide the frictional resistance to premature blade opening prior to target impact.

Turning now to FIGS. 14 through 17, a fourth preferred embodiment 89 of the target impact operative arrowhead of this invention, another broadhead design, is shown mountable at end 27 of shaft 29 of an arrow. As in the other embodiments, embodiment 89 includes arrowhead body 31 and actuator 33 relatively axially slidable and freely rotatable relative to each other upon assembly. Blades 35 are pivotably mounted at body 31 and target penetrating tip 37 is secured at the leading end of the arrowhead. Shaft mounting structure includes threaded shaft engagement post 39 and mount facilitating annular knurl 41. Blades 35 are pivotably mounted as previously illustrated, slots 47 extending onto body 31 to receive at least a portion of blades 35 therein when the arrowhead is in the armed position. Different blade of slot features, such as dimples 49 or blade curvature, cause blade contact with arrowhead body 31 in slots 47 providing frictional resistance to accidental blade opening. Honed (cutting) edges 50 and actuation contact surfaces 51 at another edge are provided at blades 35.

Embodiment 89 particularly shows rearward internal blade actuation of a broadhead type blade configuration (pivoting towards the forward section of the arrowhead body relative to the direction of arrow travel with cutting edges 50 of blades 35 exposed outside of slots 47 in the armed position) and having tip 37 mounted in the leading end of the forward section of body 31. Actuator 33 includes piston portion 61 having a blade contacting end 55 in the nature of a cam sleeve, actuation contact surfaces 51 of blades 35 in the nature of cam followers contactable within slots 47 for blade activation. Spring ring 57 (preferably stainless steel) is mounted in retention seat 59 at an external surface of piston portion 61 and is received in annular guide groove 63 defined at an axial internal surface of axial bore 64 of cylinder portion 53 at body 31. Annular guide groove 63 extends between first end 65 and second end 81 and has a substantially constant depth along the width between ends 65 and 81, positive stops thus defined as heretofore discussed. Spring ring 57 is slidable between the positive stops, with guide groove depth sufficient to accommodate free relative rotation of body 31 and actuator 33. Features of blades 35 or slots 47 (blade curvature as shown in FIG. 11, dimples 49 or other features located at the blades or slots) provide the frictional resistance sufficient to avoid premature blade opening prior to target impact.

Figure 16:
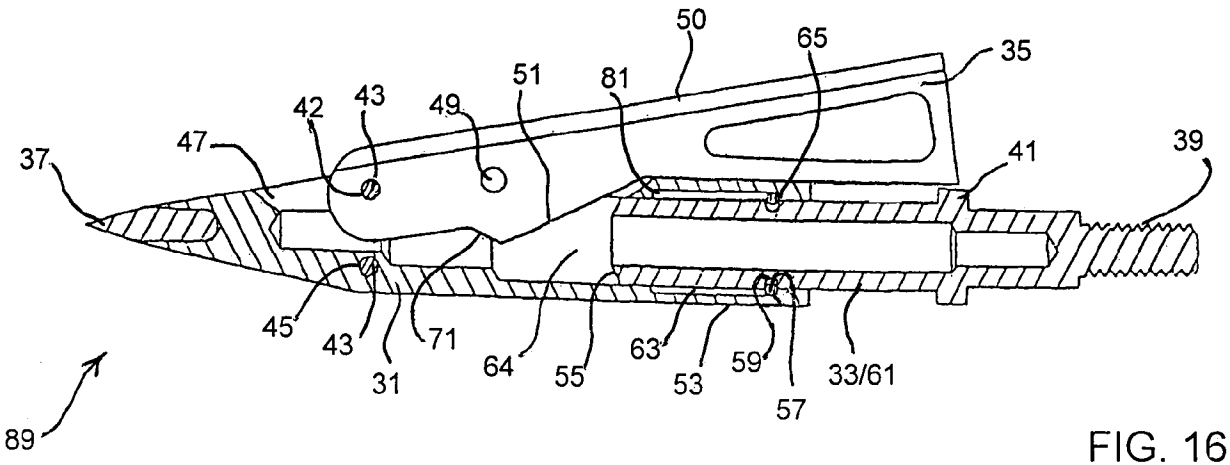
FIG. 16 is a first sectional view of an arrowhead of the type shown in FIG. 14 with the arrowhead in the armed position.
Figure 17:
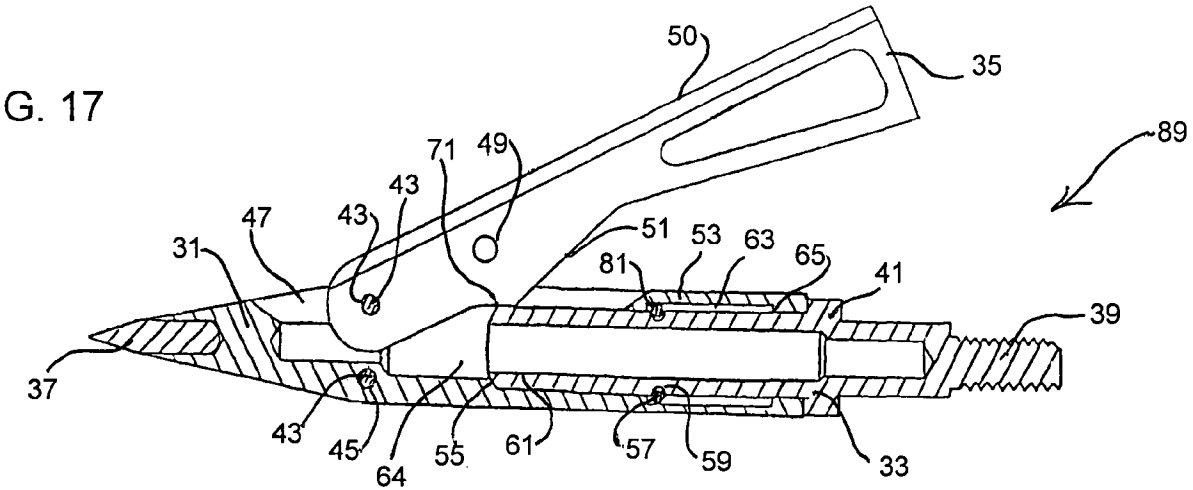
FIG. 17 is a second sectional view of the arrowhead of FIG. 14 showing the arrowhead in the activated position.

As shown in FIGS. 16 and 17, guide groove 63 is located so that, upon target impact, relative sliding movement of body 31 and actuator 33 brings blade contacting end 55 of actuator 33 into contact with actuation contact surfaces 51 of blades 35 thereby releasing blades 35 from slots 47 in body 31 and pivoting the blades on the body into position for target penetration. Released blades are thereafter restrained by continued engagement between blade contacting end 55 and released blade position retention surface 71 of blades 35. Arrow removal from a target allows blades 35 to pivot toward the tip for reduced removal diameter.

Figure 18:
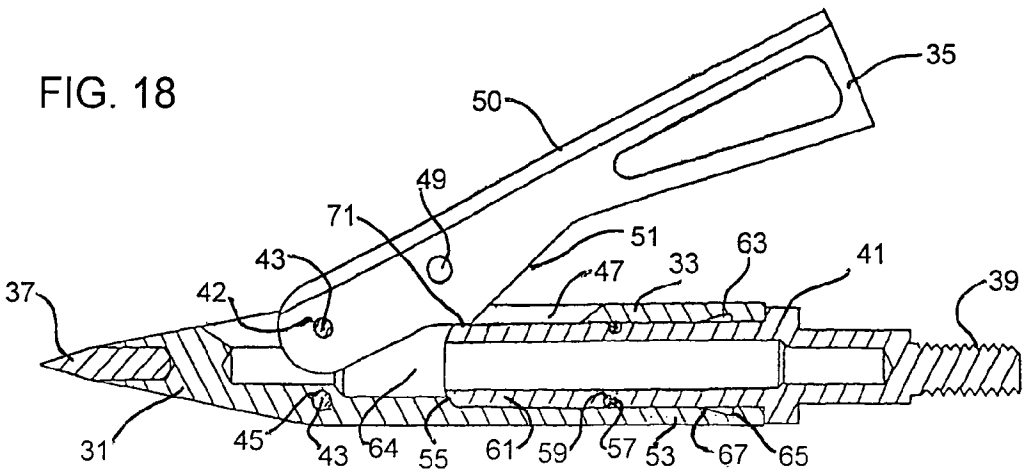
FIG. 18 is another sectional view of an arrowhead similar to that shown in FIG. 14 in most regards but using a different guide groove configuration.
Figure 20:
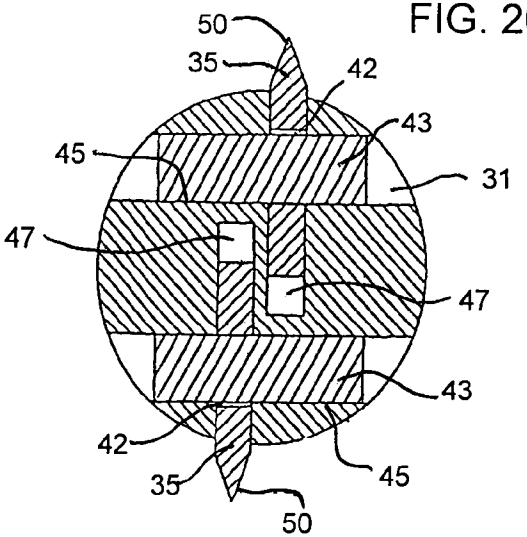
FIGS. 19 through 22 are sectional illustrations showing exemplary blade orientations and configurations utilized with the various embodiments of this invention (both two and three blade implementations are shown).
Figure 19:
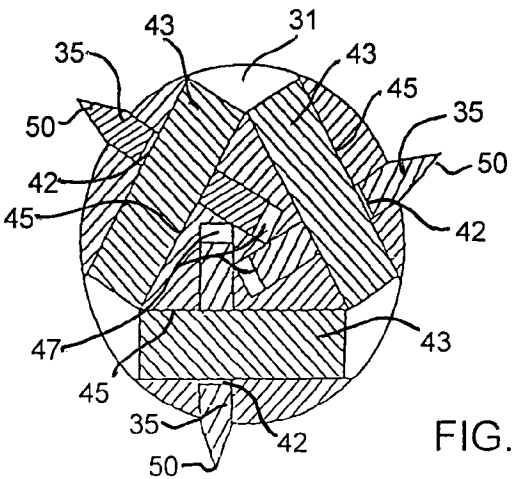
Figure 22:
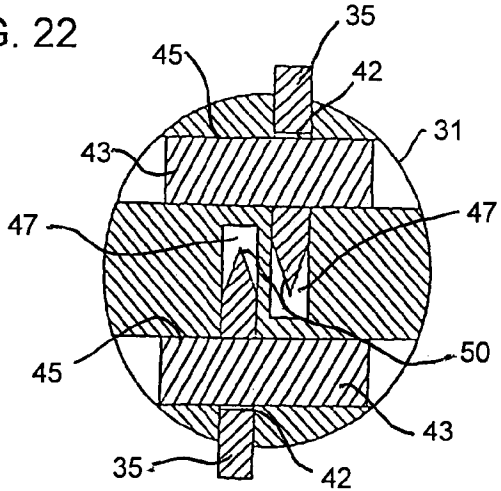
Figure 21:
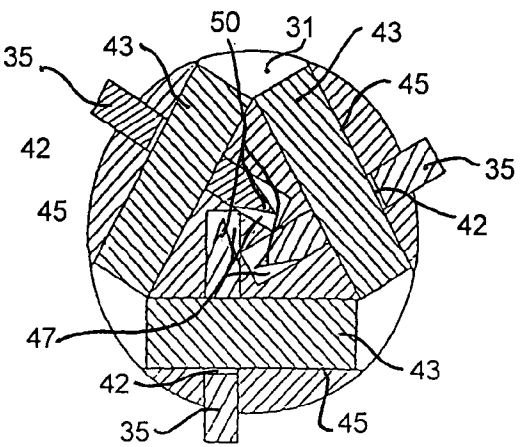

A variation applicable with embodiment 89 is shown in FIG. 18 wherein annular guide groove 63 is a tapered groove with an axial width extending from first end 65 (corresponding to ring location in the armed position) having a maximum groove depth to an axially spaced second end 67 corresponding to a full ring compression achieved during ring travel in groove 63 after target impact and during blade activation and having zero groove depth. This arrangement provides for frictional axial sliding contact of ring 57 along the width of guide groove 63 upon target impact whereupon forward inertia overcomes the frictional resistance at ring/groove 57/63 interface. As with other embodiments utilizing a tapered groove, this variation may be engineered so that inception of frictional axial sliding contact at the ring/groove 57/63 interface is selectable by providing appropriate relative component sizes, taper angle and material specifications (preferably requiring between about 4 and 6 lbs. of force).

In either embodiment 89 or its variations shown in FIG. 18, field operations are the same as provided theretofore, with piston portion 61 and cylinder portion 53 moved to a relative armed position ready for arrow firing so that upon target contact blades 35 are released from slots 47 and positioned for target penetration by virtue of sliding relative movement of the piston portion and cylinder portion.

FIGS. 19 through 22 are sectional illustrations taken through body 31 and blades 35 at their attachment point with screws 43 at threaded bore openings 45. Both two blade (FIGS. 20 and 22), three blade (FIGS. 19 and 21), broadhead (FIGS. 19 and 20), and flip-blade (FIGS. 21 and 22) type blade configurations are shown.

As may be appreciated, all embodiments of this invention share certain design features, primarily a cylinder portion 53 having an internal annular surface which receives a piston portion 61 having an external annular surface, with each located at a different one of body 31 or actuator 33, the opposite structure (either piston portion 61 or cylinder portion 53) located at the other of body 31 or actuator 33. In several of the embodiment the blades lock open at full expansion. In all embodiments, only about 0.090 inch of forward plunger/striker travel at arrow impact is preferably required to cam the blades open. The instantaneous forward motion is created by the forward inertia of the arrow when the tip strikes the target.

The low blade cutting angles of the embodiments shown herein (preferably about) 30° accommodate maximum target penetration. In most embodiments, blades/grooves 35/47 are shaped such that only the very tip of the blade contacts the bottom of the aluminum blade groove when closed to maintain maximum sharpness. Arrowhead weights may be manufactured as desired (preferably between 75 GN and 125 GN) with blade sizes providing full blade expansion in the range of 1.5 inches to 3 inches as may be desired for a particular manufacture.

By way of example, for the broadhead embodiment shown in FIG. 1, flight diameter of the arrowhead is about 0.54 inches (assisting in maintenance of flight stability resulting in greater target head accuracy) and impact diameter is about 1.75 inches. Blades 35 are preferably about 0.032 inches thick and made of 440 stainless steel (increased blade thickness can be used without changing flight diameter). Tip 37 is preferably made of 18-8 spring steel or hardened allow steel. Body 31 and actuator 33 are preferably 7075-T6 aircraft aluminum alloy with 83,000 PSI tensile strength and ring 57 is preferably of 18-8 stainless steel. Overall weight is about 100 GN. Other sizes and weights can be provided.

Figure 5:
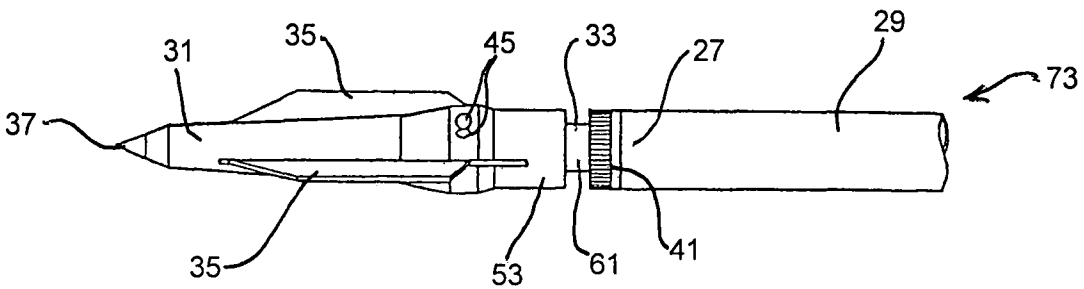
FIG. 5 side view of a second preferred embodiment of the arrowhead of this invention wherein rearward internal blade activation is utilized with reverse blade orientation and activation direction utilized (three blade implementation shown)
Figure 6:
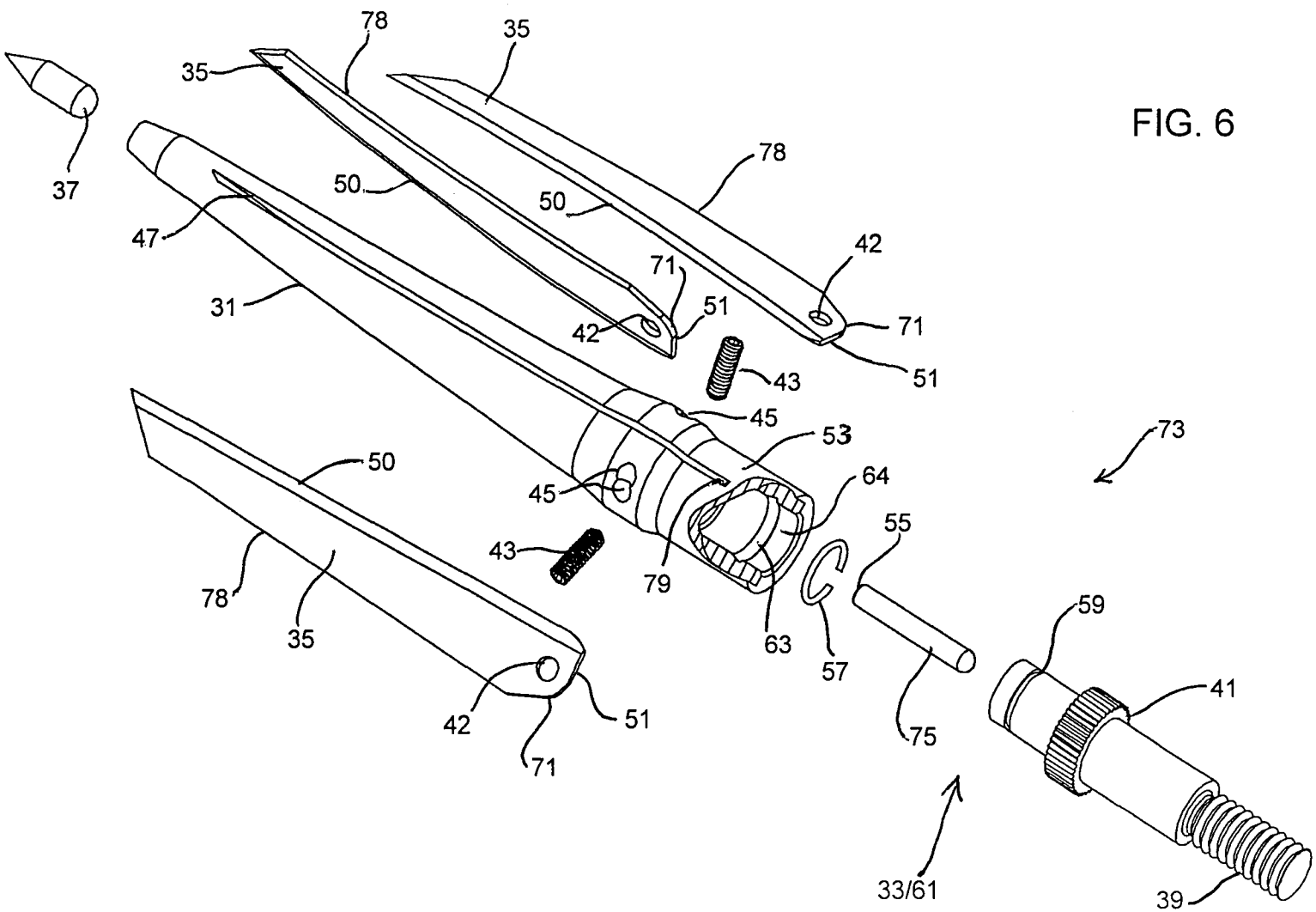
FIG. 6 is an exploded view of the arrowhead shown in FIG. 5 showing the preferred tapered guide groove configuration.

The flip-blade embodiments of FIGS. 5 and 8 provide the advantage of automatic return upon target removal to the armed position and can be made in various sizes (for example, a three blade 125 GN; a two blade, 100 GN; a three blade, 100 GN; and a three blade, 85 GN). The larger three blade design in FIG. 5 opens at impact to two inches, for example. A large two blade would preferably open to about 1.75 inches. Smaller designs such as shown in FIG. 8 would have smaller impact diameters. All are preferably constructed using mostly the same or similar materials as discussed above. Striker pins are preferably made of hardened alloy steel. The flip-blade blades 35, when penetrating a target, lower to approximately 30° relative to body 31 axis thereby maximizing penetration. Flight diameters are preferably between about 0.37 and 0.46 inches.

In flip-blade embodiments, the extreme deployment speed of the blades at impact produces a rebound (bounce-back) of blades 35 after striking the rear of the slots 47, and thus produces a maximum blade extension at entry. For example, a seventy pound draw weight compound bow can produce an average arrow speed of 300 feet per second. At arrow impact, the outer tips of blades 35 can rotate (pivot) at up to 15 times arrow speed because of the cam action (the ratio of strike speed contact at blade base to blade tip) is approximately 15 to 1 (where blade tips are 15 times the distance from the blade-pivoting axis versus the distance from the axis to the plunger striking impact point). Even with a 50% friction loss, the tip would be rotating at 7.5 times arrow speed (using this example, about 2,250 feet per second). At arrow impact, the blades 35 rotate open at this tremendous speed, striking back wall 79 of slot 47 and rebounding as the arrow head enters the target thus achieving maximum blade extension and creating the large entry wound.

Ring 57 is compressed for installation (utilizing a tool designed for such purpose) in retention seat 59 during assembly as body 31 and actuator 33 are engaged. Where tapered groove 63 is provided having a 15° taper, when actuator 33 is retracted to the armed position spring ring 57 expands into the deepest point in seat 59. When actuator 33/body 31 relative motion occurs upon target impact, spring ring 57 is compressed by the taper, creating (by design) 4 to 6 lbs. (preferably 5 lbs.) of resistance to forward motion. This resistance, in combination with blade motion resistance by frictional engagement in the body blade slots, prevents the blades from being opened by arrow inertia when the arrow is launched by the bow string and prevents opening during arrow flight (as well as accidental opening during handling). A 15° taper requires about 5 lbs. of force upon arrowhead impact for spring ring release and thus blade deployment. A 20° taper requires about 6 lbs. of force and a 10° taper requires about 4 lbs. of force for blade deployment.

As may be appreciated, improved target impact operative arrowheads are provided by this invention. Additional features not shown in the drawings can be conceived complementing the inventions disclosed herein. For example the ability to lock the blades in any radial position in relation to the arrow shaft/feather/knock positions could be provided. This could be accomplished, for example, by enlarging knurl 41 and seating the rear of blades 35 into knurl 41 (see FIG. 14), thus locking out independent free rotation of the arrow shaft from the arrowhead during flight as designed herein. Various blade designs can be used, for example radius blades, blades with two cutting planes, straight cutting edges, weight adapted cutout blades, forward blade designs, and the like.

What is claimed is:

1. A target impact operative arrowhead mountable at an end of a shaft of an arrow comprising:

an arrowhead body having blades pivotably mounted thereon with at least a portion of said blades movable into and out of slots in said body, at least one of said slots and said blades configured for frictionally resisting movement of said blades to hold said blades in said slots when said arrowhead is armed for firing and releasing said blades from said slots upon target impact, each of said blades having an actuation contact surface along an edge thereof;

an actuator axially slidably receivable at said arrowhead body and having a blade contacting end;

a spring ring; and one of said arrowhead body and said actuator having an annular retention seat defined thereat for mounting and retention of said spring ring therein and the other of said arrowhead body and said actuator having an annular guide groove with an axial width for receipt and slidable movement of said spring ring therealong while retaining said arrowhead body and said actuator assembly, said guide groove located so that, upon target impact, said blade contacting end of said actuator comes into contact with said actuation contact surfaces of said blades due to relative sliding movement of said arrowhead body and said actuator thereby releasing said blades from said slots in said body and pivoting said blades on said body into position for target penetration, said guide groove axially tapered along said axial width between an armed end having a maximum depth and a full ring compression end having zero depth thus providing frictional axial sliding contact of said ring along said width of said guide groove upon target impact.

2. The arrowhead of claim 1 wherein said guide groove width extends between first and second groove ends and wherein groove depth is substantially constant between said groove ends.

3. The arrowhead of claim 1 wherein said actuator is slidably receivable in said arrowhead body and includes said annular retention seat thereat.

4. The arrowhead of claim 1 wherein said arrowhead body includes a portion slidably receivable in said actuator and has said annular retention seat thereat.

5. The arrowhead of claim 1 wherein said blade contacting end of said actuator is a striker pin.

6. The arrowhead of claim 1 wherein said blade contacting end of said actuator is a cam sleeve.

7. The arrowhead of claim 1 wherein said actuator is slidably receivable in said arrowhead body forward of pivotable mounting of said blades and includes a target penetrating tip opposite said blade contacting end.

8. The arrowhead of claim 1 wherein said actuator is slidably receivable at said arrowhead body rearward of said blades, said arrowhead body including a target penetrating tip.

9. The arrowhead of claim 1 one of said arrowhead body and said actuator includes an arrow shaft mounting structure including a shaft engagement and a mount facilitating knurl.

10. A target impact operative arrowhead mountable at an end of a shaft of an arrow comprising:

an arrowhead body including forward and rearward sections relative to intended direction of arrow travel and having pivotable blades mounted thereon with at least a portion of said blades movable into and out of slots in said body, said bladed mounted for pivoting movement from said slots toward said rearward section, at least one of said slots and said blades configured for frictionally resisting movement of said blades to hold said blades in said slots when said arrowhead is armed for firing and releasing said blades from said slots only upon target impact, each of said blades having an actuation contact surface along an edge thereof, said arrowhead body including a cylinder portion having an internal annular surface;

an actuator configured with an opposite structure, said opposite structure including a piston portion having an external surface said opposite structure having a blade contacting end and an arrow shaft mount at an end opposite said blade contacting end, said blade contacting end including a blade striker pin;

a spring ring;

said piston portion slidably receivable in said cylinder portion and having an annular retention seat defined at said external surface thereof for mounting and retention of said spring ring therein;

said cylinder portion having an annular guide groove with a width between first and second groove ends axially spaced along said internal surface thereof for receipt of said spring ring therein and for frictional axial sliding contact of said ring therewith along said width upon target impact, said cylinder portion including said guide groove and said spring ring having relative size and material specifications selected for overcoming frictional resistance therebetween only upon axial application of between about 4 and 6 lbs. of force to said arrowhead; and said piston portion and said cylinder portion movable to a relative armed position ready for arrow firing with said spring ring at said first end of said guide groove and said blade contacting end of said opposite structure spaced from said actuation contact surfaces of said blades, and upon target contact overcoming said frictional resistance allowing relative axial movement of said spring ring along said guide groove width at least to said second end of said guide groove so that said contacting end of said opposite structure contacts said actuation contact surfaces of said blades to release said blades from said slots and position said blades for target penetration.

11. The arrowhead of claim of 10 wherein said arrowhead body is configured to receive and pivotably retain said blades so that said actuation contact surfaces of said blades are located within said arrowhead body.

12. The arrowhead of claim 10 wherein said guide groove is axially tapered with a maximum depth at said first end and achieves zero depth at said second end, said taper preferably between 10° to 20°.

13. The arrowhead of claim 12 wherein said guide groove axial taper is about 15° resulting in about a 5 lbs. axial force application requirement to overcome said frictional resistance.

14. A target impact operative arrowhead mountable at an end of a shaft of an arrow comprising:

an arrowhead body including forward and rearward sections relative to intended direction of arrow travel and having pivotable blades mounted thereon with at least a portion of said blades movable into and out of slots in said body, said blades mounted for pivoting movement from said slots toward said forward section, at least one of said slots and said blades configured for frictionally resisting movement of said blades to hold said blades in said slots when said arrowhead is armed for firing and releasing said blades from said slots only upon target impact, each of said blades having an actuation contact surface along an edge thereof, said arrowhead body having one of a cylinder portion having an internal annular surface or a piston portion having an external annular surface;

an actuator configured with an opposite structure, said opposite structure one of a piston portion having an external surface where said arrowhead body is characterized by having said cylinder portion or a cylinder portion having an internal surface where said arrowhead body is characterized by having said piston portion, said opposite structure having a blade contacting end including a blade cam sleeve, an arrow shaft mount configured at said actuator at an end opposite said blade contacting end;

a spring ring;

said piston portion slidably receivable in said cylinder portion and having an annular retention seat defined at said external surface thereof for mounting and retention of said spring ring therein;

said cylinder portion having an annular guide groove with a width between first and second groove ends axially spaced along said internal surface thereof for receipt of said spring ring therein and for frictional axial sliding contact of said ring therewith along said width upon target impact, said cylinder portion including said guide groove and said spring ring having relative size and material specifications selected for overcoming frictional resistance therebetween only upon axial application of between about 4 and 6 lbs. of force to said arrowhead; and said piston portion and said cylinder portion movable to a relative armed position ready for arrow firing with said spring ring at said first end of said guide groove and said blade contacting end of said opposite structure spaced from said actuation contact surfaces of said blades, and upon target contact overcoming said frictional resistance allowing relative axial movement of said spring ring along said guide groove width at least to said second end of said guide groove so that said contacting end of said opposite structure contacts said actuation contact surfaces of said blades to release said blades from said slots and position said blades for target penetration.

15. The arrowhead of claim of 14 wherein either one of two or more pivotable blades are mounted on said arrowhead body.

16. The arrowhead of claim of 14 wherein said actuation contact surfaces of said blades include a cam follower surface and a released blade position retention surface engagable with said blade contacting end of said opposite structure of said actuator.

17. A target impact operative arrowhead mountable at an end of a shaft of an arrow comprising:

an arrowhead body having three annularly spaced blades mounted thereon for pivoting movement between an armed position and a target penetration position, each of said blades having an actuation contact surface along an edge thereof;

an actuator axially slidably receivable at said arrowhead body and having a blade contacting end;

a spring ring;

one of said arrowhead body and said actuator having an annular retention seat defined thereat for mounting and retention of said spring ring therein and the other of said arrowhead body and said actuator having an annular guide groove with an axial width extending from a first groove end for receipt of said spring ring therein to provide assembly retention of said arrowhead body and said actuator while allowing relative axial travel of said arrowhead body and said actuator upon target impact to bring said blade contacting end of said actuator into contact with said actuation contact surfaces of said blades to pivot said blades on said body into said target penetration position;

one of said actuator and said arrowhead body having attachment means thereat for securing said arrowhead on the arrow shaft; and one of said actuator and said arrowhead body having a target penetrating tip thereat.

18. The arrowhead of claim 17 wherein said arrowhead body is slidably receivable within an axial bore of said actuator, said axial bore extending between said blade contacting end and said attachment means located at said actuator, and said tip mounted in said arrowhead body at an end opposite said actuator.

19. The arrowhead of claim of 18 wherein said blades are pivotably mounted in slots in said body with said actuation contact surfaces extending outside of said slots when said blades are moved to said armed position.

20. The arrowhead of claim of 17 wherein said arrowhead body includes two oppositely mounted blades.

21. The arrowhead of claim of 17 wherein said attachment means includes an arrow shaft engagement and a mount facilitating knurl.

22. The arrowhead of claim 17 wherein said actuator is slidably receivable within an axial bore of said arrowhead body, said axial bore located forward of said blades, said attachment means located at said arrowhead body rearward of said blades, and said tip located at said actuator at an end opposite said blade contacting end and protruding from said axial bore of said arrowhead body.

23. The arrowhead of claim of 22 wherein said blade contacting end of said actuator includes a striker pin, said blades each having a striker notch at an edge thereof contactable by said striker pin upon target contact.

24. The arrowhead of claim of 17 wherein said guide groove is axially tapered with a maximum depth at said first groove end and achieving zero depth at a second groove end thus providing frictional axial sliding contact of said spring ring therewith along at least part of said width, said arrowhead body including said blades and said actuator movable to said armed position ready for arrow firing with said spring ring at said first end of said guide groove and said blade contacting end of said actuator spaced from said actuation contact surfaces of said blades , frictional resistance at said spring ring and said guide groove overcome upon target contact allowing relatively axial movement of said arrowhead body and said actuator.

25. The arrowhead of claim of 17 wherein said guide groove has a substantially constant depth along said width between a first positive stop defined at said first end of said guide groove and second positive stop defined adjacent to a second end of said guide groove, said spring ring slidable between said positive stops, and wherein said arrowhead body includes a plurality of linear slots, at least a portion of said blades each movable into a different one of said slots in said armed position, said blades including a feature accommodating blade contact with said arrowhead body when positioned in said slots in said armed position to provide frictional resistance to blade opening from said armed position prior to target impact.

26. The arrowhead of claim 17 wherein said guide groove depth at least at said first groove end is sufficient to allow free relative rotation of said arrowhead body and said actuator.

* * * * *